US005685283A

United States Patent [19]

Nishioka et al.

[11] Patent Number: 5,685,283

[45] Date of Patent: Nov. 11, 1997

[54] AIR-FUEL RATIO CONTROL SYSTEM FOR ENGINE

[75] Inventors: Futoshi Nishioka; Tetsushi Hosokai, both of Hiroshima, Japan

[73] Assignee: Mazda Motor Corporation, Hiroshima, Japan

[21] Appl. No.: 497,330

[22] Filed: Jun. 30, 1995

[30] Foreign Application Priority Data

Jul. 1, 1994 [JP] Japan ..... 6-151109
Aug. 23, 1994 [JP] Japan ..... 6-222439

[51] Int. Cl.[6] ..... F02D 41/14

[52] U.S. Cl. ..... 123/680; 123/681; 123/687

[58] Field of Search ..... 123/680–684, 123/687, 695

[56] References Cited

U.S. PATENT DOCUMENTS 4,561,403 12/1985 Oyama et al. ..... 123/682
4,594,984 6/1986 Raff et al. ..... 123/695

FOREIGN PATENT DOCUMENTS 63-12850 1/1988 Japan ..... 123/681

*Primary Examiner*—Andrew M. Dolinar

*Attorney, Agent, or Firm*—Sixbey, Friedman, Leedom & Ferguson, P.C.; Gerald J. Ferguson, Jr.; Donald R. Studebaker

[57] ABSTRACT

An air-fuel ratio control system for an engine for controlling an amount of a fuel mixture to be delivered into a combustion chamber so that an air-fuel ratio of the fuel mixture attains a target air-fuel ratio performs selecting one of a plurality of predetermined target air-fuel ratios according to engine operating conditions, controlling an amount of a fuel mixture so as to attain a selected target air-fuel ratio, and changing a speed at which the target air-fuel ratio is changed from one to another ratio higher with an increase in deviation of the other target air-fuel ratio from the one target air-fuel ratio.

16 Claims, 7 Drawing Sheets

FIG.4A
FIG.4B
FIG.4C
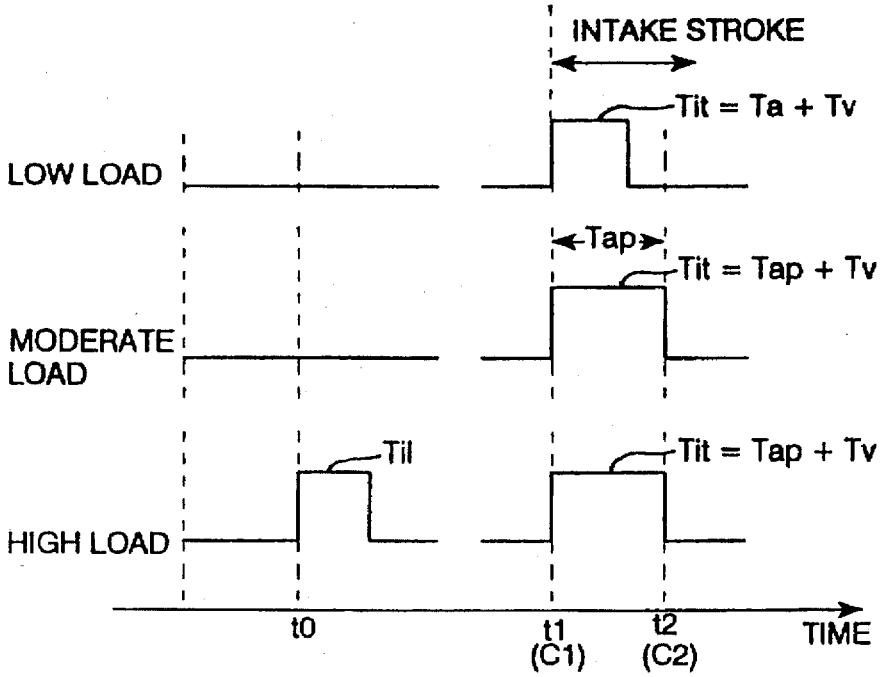
FIG.5
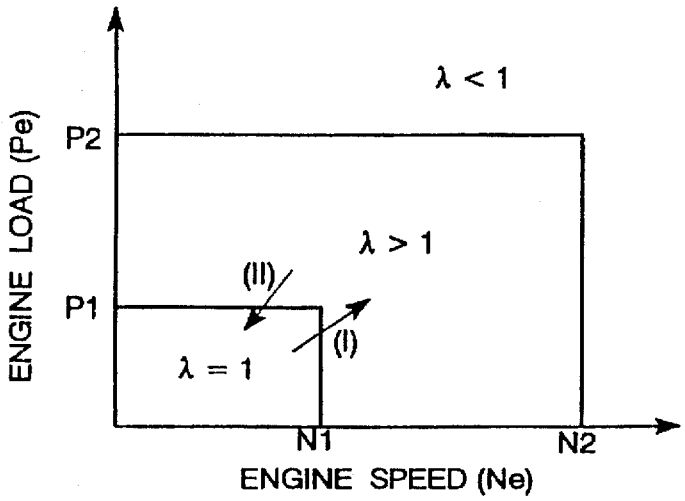

FIG.7A AIR-FUEL RATIO IN RANGE OF OPERATING CONDITIONS
FIG.7B TARGET AIR-FUEL RATIO
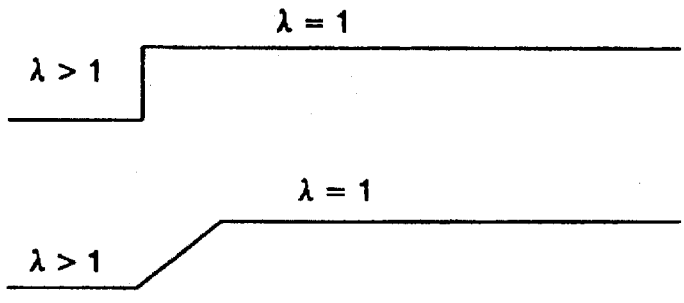
FIG.7C AIR-FUEL RATIO IN RANGE OF OPERATING CONDITIONS
FIG.7D TARGET AIR-FUEL RATIO
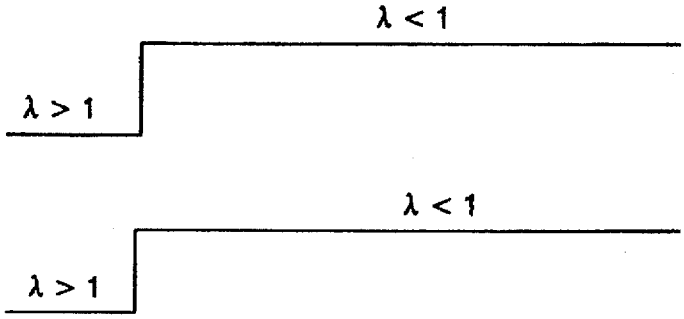
FIG.8A AIR-FUEL RATIO IN RANGE OF OPERATING CONDITIONS
FIG.8B TARGET AIR-FUEL RATIO
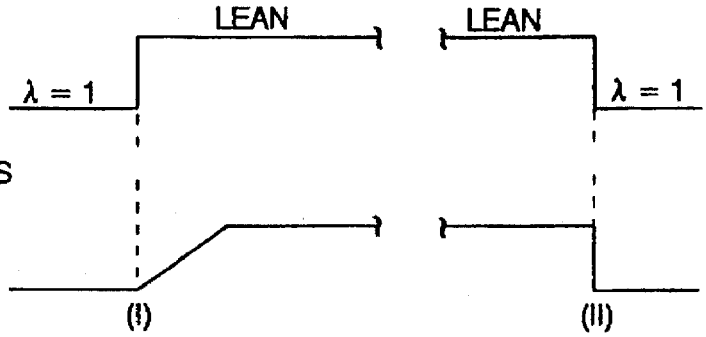

AIR-FUEL RATIO CONTROL SYSTEM FOR ENGINE

BACKGROUND OF THE INVENTION

1. Field of the Invention

The resent invention relates to an air-fuel ratio control system for an internal combustion engine for changing a target air-fuel ratio according to engine operating conditions.

2. Description of Related Art

In order for internal combustion engines to yield improved fuel economy or fuel combustion efficiency, it has been known to produce stratified fuel mixture in an combustion chamber and/or to accelerate atomization and evaporation of fuel by means of adjusting timing of fuel injection to achieve, on one hand, improved combustibility of a fuel mixture and, on the other hand, combustion of a fuel mixture leaner than an stoichiometric air-fuel ratio in a specific range of engine operating conditions. Further, in recent years, there are various closed loop or feedback air-fuel ratio control systems having been put to practical use which determine the oxygen content of exhaust and constantly monitor the exhaust to verify the accuracy of the fuel mixture setting based on a deviation from a target air-fuel ratio according to a specific engine operating condition. Such a feedback air-fuel ratio control system possibly causes what is called "torque shocks" following an abrupt increasing or decreasing change in the amount of injected fuel due to a sudden change in target air-fuel ratio according to engine operating conditions.

One of various effort having been made to alleviate such torque shock is that described in Japanese Unexamined Utility Model Publication No. 59 - 81743. The approach used is to cause changing a target air-fuel ratio more slowly along with a decrease in degree of changing throttle opening. While the feedback air-fuel ratio control system may have advantages over prior art, nevertheless, it is unavoidable to take a long time until the complete change of a present target air-fuel ratio when the throttle opening changes in great degree, for instance when there occurs a change from a lean air-fuel ratio higher than an stoichiometric air-fuel ratio to a rich air-fuel ratio lower than stoichiometric air-fuel ratio in a single leap. In such a case, a considerable delay occurs until a target air-fuel ratio matching the present engine operating condition, leading to deterioration of the responsiveness of engine output. In particular, with internal combustion engines which are designed and adapted to reduce engine knocking by an utilization of the latent heat of fuel evaporation created by establishing a target air-fuel ratio to be rather rich in a range of high engine loads, if there is a considerable delay in the change of target air-fuel ratio upon a conversion of engine load from a moderate engine load range where a lean burn is effected to a high engine load range where an enriched burn is effected, the engine is difficult to reduce knocking sufficiently.

Another approach is, on one side, to change a target air-fuel ratio on the lean side to an stoichiometric air-fuel ratio relatively slowly so as to prevent an occurrence of torque shock and, on the other hand, to accelerate the change of target air-fuel ratio toward the lean side from the stoichiometric air-fuel ratio so as to prevent a long stay at an air-fuel ratio of approximately 16 which increases emission of oxides of nitrogen (NOx) into the atmosphere. Such an air-fuel ratio control system is known from Japanese Unexamined Patent Publication No. 63 - 12850. Even for lean burn engines in which an air-fuel ratio is set leaner than the stoichiometric air-fuel ratio in a specific range of low engine loads so as to provide an improvement of fuel economy or fuel combustion efficiency, it is usual to change an air-fuel ratio toward the rich side, such as the stoichiometric air-fuel ratio, in an idling range of engine loads so as to secure reliable combustibility. In such the case, the prior art air-fuel control system changes an air-fuel ratio gradually toward the stoichiometric air-fuel ratio from the lean side during shifts from a range of low engine loads to an idling range of engine loads. Such a shift causes a drop in engine load accompanied by a drop in engine speed. In particular, the engine speed drop is great upon an application of abrupt brake, lowering engine output. Together, during the shift from the engine load range to the idling engine load range, the air-fuel ratio stays in a long-lived lean state due to a gradual change, possibly passing a lean limit for the idling engine load range. This is apt to cause an accidental firing due to over lean air-fuel ratios. Consequently, the prior art air-fuel ratio control system possibly causes a drop in engine output and an accidental firing together which leads to an engine stall.

Further, while, in order for engines to be prevented from causing torque shocks, it is effective to cause gradually changing an air-fuel ratio between the rich side and the lean side, nevertheless, there is caused aggravation of reliable combustibility due to a delay of changing an air-fuel ratio toward the rich side during a shift from the lean side to the rich side where it is essential to develop a rich air-fuel ratio. Such a delay of air-fuel ratio change may cause an engine stall during a shift of engine operating conditions from the lean side toward the rich side even in ranges of engine loads other than the idling engine load range.

SUMMARY OF THE INVENTION

It is an object of the present invention to provide an air-fuel ratio control system for an internal combustion engine for changing an air-fuel ratio according to engine operating conditions which can alleviate torque shocks due to changes in air-fuel ratio and eliminate knocking due to a delay of changing an air-fuel ratio.

It is another object of the present invention to provide an air-fuel ratio control system for an internal combustion engine for changing an air-fuel ratio according to engine operating conditions which can prevent an engine stall due to a drop in engine output and over lean air-fuel ratios during a change in air-fuel ratio from the lean side to the rich side such as, in particular, upon deceleration of the engine from off-idling to idling.

The present invention has been made on the basis of the discoveries that there is an issues such as an engine stall if changing a target air-fuel ratio evenly in view of the prevention of torque shocks only and that it is advantageous to solving the issue to change a target air-fuel ratio taking a serious view of prevention of torque shocks during a shift of the target air-fuel ratio toward the lean side in which aggravation of reliable combustibility is not feared and increase the speed of changing a target air-fuel ratio during a shift of the target air-fuel ratio toward the rich side in order to prevent an engine stall even allowing torque shocks to a certain extent.

The above objects of the present invention are achieved by providing an air-fuel ratio control system for an internal combustion engine for controlling a fuel mixture to be delivered into a combustion chamber so that an air-fuel ratio of the fuel mixture attains a target air-fuel ratio. The air-fuel ratio control system includes a target air-fuel ratio changing means for changing a target air-fuel ratio to a first predetermined target air-fuel ratio on a lean side, preferably larger than an stoichiometric air-fuel ratio, when engine operating conditions are in a first predetermined range of engine operating conditions where engine loads are larger than a specified engine load, such as equal approximately to an engine load during engine idling, and to a second predetermined target air-fuel ratio on a rich side, equal approximately to the stoichiometric air-fuel ratio, when engine operating conditions are in a second predetermined range of engine operating conditions where engine loads are smaller than said specified engine load and adjacent to said first predetermined range of engine loads, a speed changing means for changing a speed at which the target air-fuel ratio changing means changes a target air-fuel ratio higher upon a shift from the first target air-fuel ratio toward the second target air-fuel ratio than upon a shift from the second target air-fuel ratio toward the first target air-fuel ratio, and an air-fuel ratio control means for controlling an amount of fuel delivered into the combustion chamber so that the target air-fuel ratio changed by the target air-fuel ratio changing means is attained.

The target air-fuel ratio changing means may change a current target air-fuel ratio by reducing a target air-fuel ratio in one of the first and second predetermined range of engine operating conditions by a specified rate when engine operating conditions shift from the one predetermined range of engine operating conditions to another predetermined range of engine operating conditions and by increasing a target air-fuel ratio in the other specified range of engine operating conditions by another specified rate, less than the specified rate, when engine operating conditions are in the other predetermined range of engine operating conditions. Together, the speed changing means may change each specified rate differently between a shift from the first predetermined target air-fuel ratio to the second predetermined target air-fuel ratio and a shift from the second predetermined target air-fuel ratio to the first predetermined target air-fuel ratio.

According to another embodiment, an air-fuel ratio control system includes a target air-fuel ratio changing means for selecting one of a plurality of predetermined target air-fuel ratios according to engine operating conditions, a fuel injection control means for controlling an amount of a fuel mixture so as to attain a selected target air-fuel ratio, and a speed changing means for changing a speed at which the target air-fuel ratio changing means changes a target air-fuel ratio from one to another ratio higher with an increase in deviation of the other target air-fuel ratio from the one target air-fuel ratio. The predetermined target air-fuel ratios include a first target air-fuel ratio, such as larger than an stoichiometric air-fuel ratio, for a predetermined moderate range of engine loads, a second target air-fuel ratio less than the first target air-fuel ratio, such as equal approximately to the stoichiometric air-fuel ratio, for a predetermined low range of engine loads on a lower side of the moderate range of engine loads, and a third target air-fuel ratio less than the second target air-fuel ratio for a predetermined high range of engine loads on a higher side of said predetermined moderate range of engine loads.

The first predetermined range of engine operating conditions may be defined with either one or both of engine loads and engine speeds larger than a specified engine load and a specified engine speed, respectively, and the second predetermined range of engine operating conditions may defined with either or both of engine loads and engine speeds smaller than said specified engine load and speed, respectively. Further, the target air-fuel ratio may changed faster during a shift between the first and third target air-fuel ratios than during a shift between the first and second target air-fuel ratios.

With the air-fuel ratio control system of the present invention, because, during a shift of target air-fuel ratio, the greater the change in target air-fuel ratio, the higher the speed at which the target air-fuel ratio is shifted, the shift of target air-fuel ratio is performed within a desired period of time, providing alleviation of torque shocks. When there is a shift of engine operating conditions between the moderate range and the low or idling range, the target air-fuel ratio is changed slowly between the first and second target air-fuel ratios, so as to prevent torque shocks. On the other hand, when there is a shift of engine operating conditions between the moderate range and the high range, the target air-fuel ratio is changed abruptly between the first target air-fuel ratio and the third target air-fuel ratio which is smaller than both second and stoichiometric air-fuel ratios, so that there does not occur a long delay of changing to the third target air-fuel ratio during the shift of engine operating conditions from the moderate range to the high range, achieving a reliable responsiveness of engine output to the shift of engine operating conditions to the high range. In addition, the abrupt change to the third target air-fuel ratio without a delay during the shift of engine operating conditions from the moderate range to the high range provides a drop in speed of fuel combustion by an utilization of the latent heat of fuel evaporation, preventing effectively engine knocking in the high range of engine operating conditions.

BRIEF DESCRIPTION OF THE DRAWINGS

The above and other objects and features of the present invention will be clearly understood from the following description with respect to a preferred embodiment thereof when considered in conjunction with the accompanying drawings, in which:

FIG. 4 is a time chart of the calculation of a demanded amount of fuel delivery;

FIG. 5 is a diagram showing ranges of engine operating conditions for setting target air-fuel ratios;

FIGS. 7A and 7B are a time chart of changing a target air-fuel ratio during a shift of engine operating conditions from a moderate range of engine operating conditions to a low range of engine operating conditions;

FIGS. 7C and 7D are a time chart of changing a target air-fuel ratio during a shift of engine operating conditions from the moderate range of engine operating conditions to a high range of engine operating conditions;

FIG. 8 is a time chart of changing a target air-fuel ratio during a shift of engine operating conditions between the moderate range of engine operating conditions and the high range of engine operating conditions.

DETAILED DESCRIPTION OF THE PREFERRED EMBODIMENTS

Figure 1:
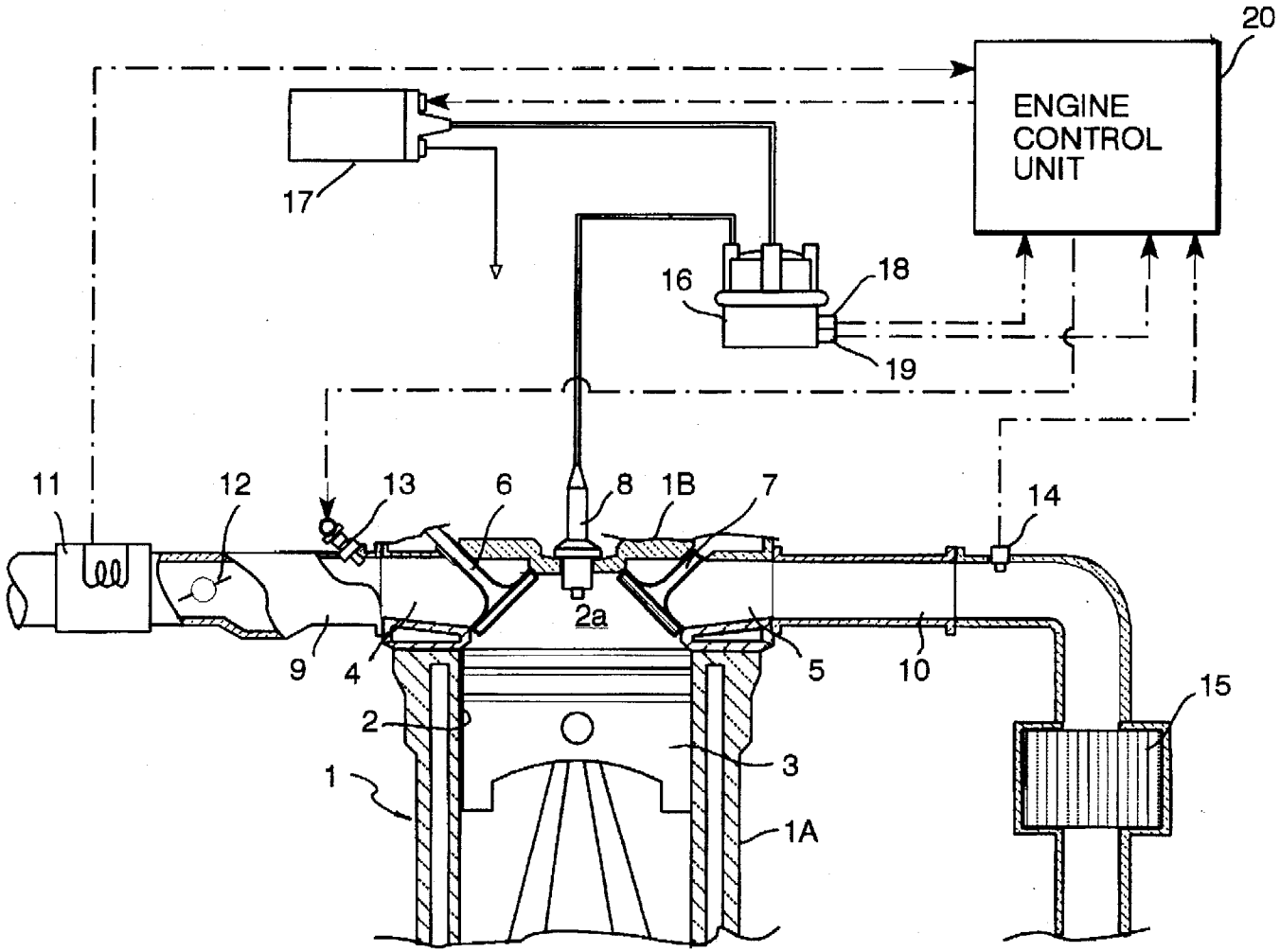
FIG. 1 is a schematic illustration of an internal combustion engine with an air-fuel control system in accordance with a preferred embodiment of the present invention.

Referring now to the drawings in detail, and in particular, to FIG. 1, an internal combustion engine 1 equipped with an air-fuel ratio control system in accordance with an embodiment of the present invention has a cylinder block 1A in which a plurality of cylinders 2 (only one of which is shown) are provided. A cylinder head 1B, shown partly, is mounted on the cylinder block 1A. A combustion chamber 2*a* is formed in the cylinder 2 by the top of a piston 3, a lower wall of the cylinder head 1B and the cylinder bore 1*a*. The cylinder 2 is provided with an intake port 4 and an exhaust port 5 which open into a combustion chamber 2*a* and are opened and shut at a predetermined timing by an intake valve 6 and an exhaust valve 7, respectively. The cylinder head 1B is provided with a spark plug 8 whose electrodes protrude in the combustion chamber 2*a*.

Intake air is introduced into the cylinder 2 through an intake pipe 9 via the intake port 4. The intake pipe 9 is provided in order from the upstream end with an air flow sensor 11, a throttle valve 12 and a fuel injection valve 13 all of which may take any known types, respectively. Exhaust gas is discharged out from the cylinder 2 through an exhaust pipe 10 via the exhaust port 5. The exhaust pipe 10 is provided in order from the upstream end with a linear oxygen ($O_2$) sensor 14, functioning as an air-fuel ratio sensor, and a catalytic converter 15, such as an NOx reduction catalytic converter of the type having a distinguished capability of purifying or eliminating oxides of nitrogen (NOx) in the exhaust for air-fuel ratios leaner than an stoichiometric air-fuel ratio. The linear oxygen ($O_2$) sensor 14 determines the oxygen content of exhaust which corresponds to an air-fuel ratio and provides an output signal changeable approximately linearly.

For correct ignition timing, the cylinder 2 receives a spark at the plug electrodes of the spark plug 8 as the piston 3 nears the top (few degrees before TDC) of its combustion stroke. This is made by the proper hookup of the shaft of a distributor 16 to a crankshaft (not shown). High voltage leaving an ignition coil 17 is carried to the spark plug 8 at a correct timing provided by the distributor 16. The distributor 16 is provided with an angle sensor 18 and a cylinder sensor 19. The angle sensor 18 provides signals at regular angles of turn of the crankshaft from which the effective speed of engine is determined. The cylinder sensor 19 is of the type which provides a signal in a specific relationship relative to the angle signal provided by the angle sensor 18. The correlation between these signals specifies the respective cylinders 2.

An engine control unit (ECU) 20, which mainly comprises a microcomputer, receives signals from these sensors 11, 14 18 and 19 and provides a pulse signal for pulsing the fuel injector. Pulsing an injector refers to energizing a solenoid causing the injector. Pulse width is a measurement of how long the injector is kept open -the wider the pulse width, the longer the open time. The amount of fuel delivered by a given injector depends upon the pulse width. The injector 13 is timely caused at a correct timing of pulsing.

Figure 2:
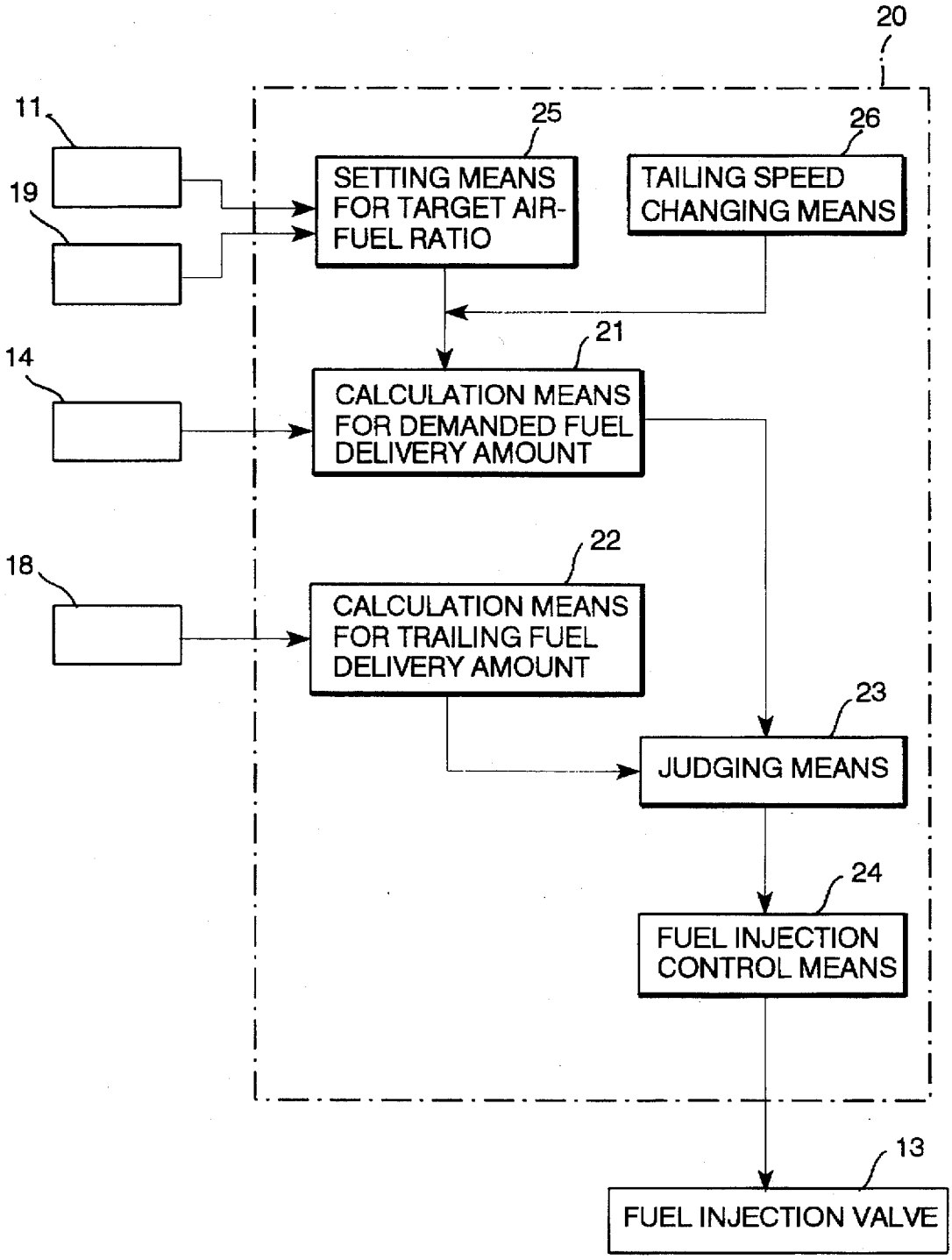
FIG. 2 is a block diagram illustrating an engine control unit.

Describing more specifically, as shown in FIG. 2, the engine control unit 20 includes various functional blocks 21–26. A target air-fuel ratio establishing means 25 establishes a target air-fuel ratio according to engine operating conditions. Specifically, as shown in FIG. 5, the target air-fuel ratio is established such that it takes an stoichiometric air-fuel ratio (which is referred to as a second air-fuel ratio) at which an excessive air rate λ takes 1 (one) when the engine is operating in a second or low range of engine operating conditions, such as an idling range, less than a lower specified engine load P1 and a lower specified engine speed N1; a specifies rich air-fuel ratio less than the stoichiometric air-fuel ratio (which is referred to as a third air-fuel ratio) at which the excessive air rate λ, is less than 1 (one) when the engine is operating in a third or high range of engine operating conditions greater than an upper specified engine load P2 and an upper specified engine speed N2; and a specified lean air-fuel ratio greater than the second air-fuel ratio, i.e. the stoichiometric air-fuel ratio, but less than the third air-fuel ratio (which is referred to as a first air-fuel ratio) at which the excessive air rate λ is greater than 1 (one) when the engine is operating in a first or moderate range of engine operating conditions between the upper and lower engine loads P1 and P2 and between the upper and lower engine speeds N1 and N2. As will be described in detail later, the speed at which the target air-fuel ratio is changed when engine operating conditions shift from one range to another range. This function is performed by a speed changing means 26.

A required fuel amount determining means 21 performs feedback control based on a deviation of an actually required air-fuel ratio determined by means of the oxygen ($O_2$) sensor 14 from a target air-fuel ratio established by the target air-fuel ratio establishing means 25 so as to provide the eventual required amount of fuel to be delivered by a given injector suitable for engine operating conditions, such as an engine load Pe and an engine speed Ne detected by the air flow sensor 11 and the angle sensor 18, thereby bringing the actual air-fuel ratio to the target air-fuel ratio. A trailing fuel amount determining means 22 determines a potential amount of trailing fuel delivery at a timing, which will be described later. These fuel amount determining means 21 and 22 perform the determination of fuel amounts, respectively, at a timing of the determination of the amount of leading fuel injection. A judging means 23 determines which is larger between the demanded amount of fuel delivery and the potential amount of trailing fuel delivery. A fuel delivery control means 24 determines timings of leading fuel delivery and trailing fuel delivery and controls the pulse width at the timings.

Figure 3:
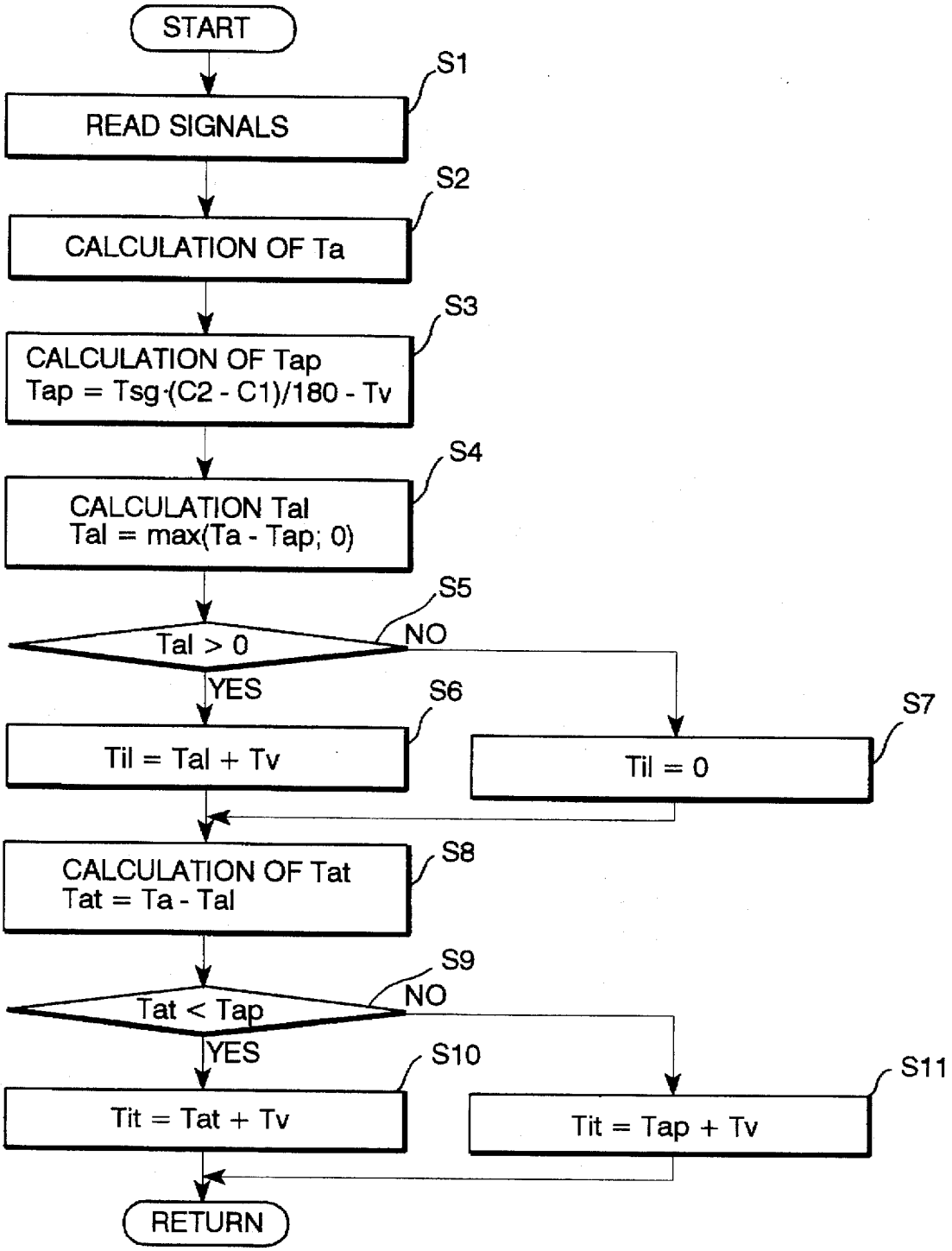
FIG. 3 is a flow chart of a sequence routine of the calculation of a demanded amount of fuel delivery.
Figure 6:
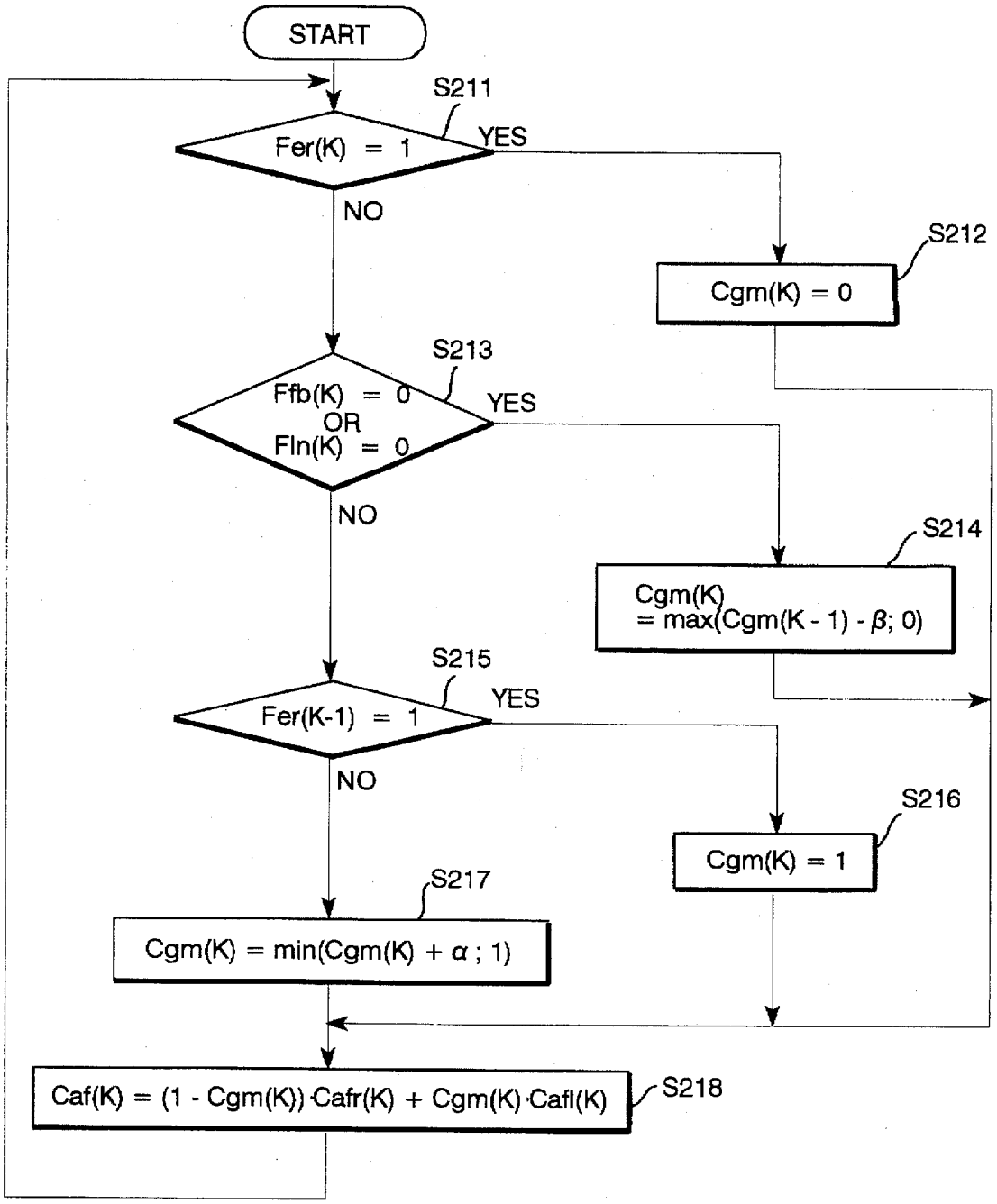
FIG. 6 is a flow chart of a sequence routine of the determination of a target air-fuel ratio.

The operation of the air-fuel ratio control system depicted in FIGS. 1 and 2 is best understood by reviewing FIGS. 3, 6 and 8, which are flow charts illustrating various routines for the microcomputer of the engine control unit 20. Programming a computer is a skill well understood in the art. The following description is written to enable a programmer having ordinary skill in the art to prepare an appropriate program for the microcomputer. The particular details of any such program would of course depend upon the architecture of the particular computer selected.

FIG. 3 is a flow chart of the sequence routine of calculation of the amount of fuel delivery for the microcomputer in which fuel delivery is divided into two times, namely leading fuel delivery and trailing fuel delivery. The sequence commences and control proceeds directly to step S1 where various signals are read. At step S2, a demanded amount of fuel Ta to be delivered by a given injector 13 is calculated based on an engine load Pe and an engine speed Ne detected by the air flow sensor 11 and the angle sensor 18, respectively. This demanded amount of fuel delivery is obtained by feedback controlling a basic amount of fuel delivery which theoretically gives a target air-fuel ratio. As will be described in detail in connection with FIG. 9, this feedback control is performed based on a deviation of an actual air-fuel ratio determined by means of the oxygen ($O_2$) sensor 14 from a target air-fuel ratio established by the target air-fuel ratio establishing means 25. A potential amount of trailing fuel delivery Tap is calculated at step S3. Letting an angle of commencement of trailing fuel delivery, the greatest allowable angle of termination of trailing fuel delivery, a cycle of the periodical signal Tsg which is provided every 180° of turn of the crankshaft and an ineffective delivery time according to a battery potential be C1, C2, Tsg and Tv, respectively, the potential amount of trailing fuel delivery Tap is given by the following equation:

$$Tap=Tsg\cdot(C2-C1)/180-Tv$$

Subsequently, a demanded amount of leading fuel delivery Tal is determined at step S4. For the demanded amount of leading fuel delivery Tal, either one of a difference (Ta–Tap) of the demanded amount of fuel delivery Ta from the potential amount of trailing fuel delivery Tap and 0 (zero), which is larger than the other, is substituted. In other words, if the demanded amount of fuel delivery Ta is larger than the potential amount of trailing fuel delivery Tap, the difference between them is substituted for the demanded amount of leading fuel delivery Tal. On the other hand, if the demanded amount of fuel delivery Ta is less than the potential amount of trailing fuel delivery Tap, the demanded amount of leading fuel delivery Tal is let equal to zero (0). A decision is made at step S5 as to whether the demanded amount of leading fuel delivery Tal is greater than zero (0). If the answer to the decision is "YES," then, at step S6, the pulse width Til of a leading injection pulse is determined so as to give the amount of fuel delivery equal to the demanded amount of leading fuel delivery Tal with the ineffective delivery time Tv added together. On the other hand, if the answer to the decision is "NO," this indicates that the demanded amount of fuel delivery Ta is zero (0), then, the pulse width Til of a leading injection pulse is determined to be zero (0) at step S7.

Thereafter, at step S8, a demanded amount of trailing fuel delivery Tat is obtained by subtracting the demanded amount of leading fuel delivery Tal from the demanded amount of fuel delivery Ta. Consequently, if the demanded amount of fuel delivery Ta is less than the potential amount of trailing fuel delivery Tap, in other words, if the pulse width Til of an injection pulse is zero (0), the demanded amount of fuel delivery Ta is taken as the demanded amount of trailing fuel delivery Tat. On the other hand, if the demanded amount of fuel delivery Ta is greater than the potential amount of trailing fuel delivery Tap, the potential amount of trailing fuel delivery Tap is taken as the demanded amount of trailing fuel delivery Tat. At step S9, another decision is made as to whether the demanded amount of trailing fuel delivery Tat is less than the potential amount of trailing fuel delivery Tap. If the answer to the decision is "YES," then, at step S10, the pulse width Tit of a trailing injection pulse is determined so as to give the amount of fuel delivery equal to the demanded amount of trailing fuel delivery Tat with the ineffective delivery time Tv added together. On the other hand, if the answer to the decision is "NO," this indicates that the demanded amount of trailing fuel delivery Tat is greater than the potential amount of trailing fuel delivery Tap, then, at step S11, the pulse width Tit of a trailing injection pulse is determined so as to give the amount of fuel delivery equal to the potential amount of trailing fuel delivery Tap with the ineffective delivery time Tv added together.

The operation described above is shown in a time chart in FIG. 4. The entire demanded amount of fuel delivery may be made all at a time.

The calculation of demanded amount of fuel delivery Ta at step S2 includes establishing a target air-fuel ratio and calculating a feedback control correction value.

Referring to FIG. 6, which is a flow chart of the sequence routine of establishing a target air-fuel ratio, there are used flags, namely an enriched fuel flag Fer(K), a feedback control flag Ffb(K) and a lean fuel flag Fln(K). The enriched fuel flag Fer(K) is up or set to a state of "1" when an air-fuel ratio Cfb(K) for a range in which present engine operating conditions fall is less than the stoichiometric air-fuel ratio and is down or reset to a state of "0" in all circumstances other than that the present air-fuel ratio is less than the stoichiometric air-fuel ratio. The feedback control flag Ffb (K) is up or set to a state of "1" when present engine operating conditions satisfy predetermined feedback control conditions, such as engine coolant temperatures higher than a predetermined temperature, and is down or reset to a state of "0" when present engine operating conditions do not satisfy the predetermined feedback control conditions. The lean fuel flag Fln(K) is up or set to a state of "1" when an air-fuel ratio Cfb(K) for a range in which present engine operating conditions fall is greater than the stoichiometric air-fuel ratio and is down or reset to a state of "0" when that the present air-fuel ratio is less than the stoichiometric air-fuel ratio. Together, the term "tailing" used hereafter shall mean and refer to changing the air-fuel ratio, and the term "tailing factor" used hereafter shall mean and refer to a factor or coefficient for determining the speed of tailing progression.

The sequence commences and control proceeds directly to step S211 where a decision is made as to whether the enriched fuel flag Fer(K) has been set to the state of "1." If the answer to the decision is "YES," this indicates that the present engine operating condition is in the third range of engine operating conditions where the excessive air rate λ is less than 1 (one), then, a tailing factor Cgm is set zero (0) at step S212. In the third range of engine operating conditions, the feedback control is not performed and the amount of fuel delivery necessary to get a target air-fuel ratio is simply calculated.

On the other hand, if the answer to the decision is "NO," then, a decision is further made at step 213 as to whether either or both of the enriched fuel flag Fer(K) and the lean fuel flag Fln(K) have been down. If the answer to the decision is "YES," this indicates that the present engine operating condition does not fall under the feedback control conditions or is otherwise in the first or moderate range of engine operating conditions where the excessive air rate λ is greater than to 1 (one), then, a current tailing factor Cgm (K) takes either one of the difference of the preceding tailing factor Cgm(K–1) from a predetermined value β, greater than zero (0) but less than 1 (one), and zero (0), which is greater than another, at step S214. If the answer to the decision is "NO," this indicates that both enriched fuel flag Fer(K) and lean fuel flag Fln(K) have been up, another decision is subsequently made at step S215 as to whether the enriched fuel flag Fer was up in the precedent sequence. The answer to the decision is "YES," this indicates that the present engine operating condition has shifted into the third range of engine operating conditions where the excessive air rate λ is less than 1 (one) from the first range of engine operating conditions where the excessive air rate λ is greater than 1 (one), then, at step S216, the tailing factor Cgm(K) is set 1 (one). On the other hand, the answer to the decision is "NO," the tailing factor Cgm(K) takes either one of the preceding tailing factor Cgm(K–1) added with a predetermined value a, greater than zero (0) but less than the predetermined value β, together and one (1), which is less than another, at step S217. After the determination of tailing factor Cgm(K), a current target air-fuel ratio Caf(K) is calculated from the following equation:

$$Caf=[1-Cgm(K)]\cdot Cafr(K)+Cgm(K)\cdot Cafl(K)$$

where Cafr(K) is either one of the second target air-fuel ratio i.e. the stoichiometric air-fuel ratio, and the third target air-fuel ratio, and Cafl(K) is the first air-fuel ratio.

As clearly understood from the above equation, each of the target air-fuel ratios Cafr and Cafl is increasingly or decreasingly weighted by an utilization of the trailing factor Cgm. Because the value $\alpha$ is less than the value $\beta$, when the present engine operating condition does not fall in the first or moderate range of engine operating conditions, the proportion of reflection of the target air-fuel ratio Cafl(K) on the lean side changes rather leniently. Consequently, the target air-fuel ratio Cafr(K) on the rich side is more reflective on the target air-fuel ratio Caf(K) than the target air-fuel ratio Cafl(K) on the lean side, enabling the target air-fuel ratio Caf(K) to shift to the lean side target air-fuel ratio Cafl(K) gently. On the other hand, when the present engine operating condition falls in the first or moderate range of engine operating conditions, the proportion of reflection of the target air-fuel ratio Cafl(K) on the lean side changes rather abruptly. Consequently, the target air-fuel ratio Cafl(K) on the lean side is less reflective on the target air-fuel ratio Caf(K) than the target air-fuel ratio Cafr(K) on the lean side, enabling the target air-fuel ratio Caf(K) to shift to the rich side target air-fuel ratio Cafr(K) rapidly.

The target air-fuel ratio Caf(K), which is obtained by substituting the tailing factor Cgm(K) determined at step S214, S216 or S217 into the above equation, is established in the following four phases according to engine operating conditions:

(1) During a shift of engine operation conditions from the first range to the second range, the target air-fuel ratio Caf(K) is gradually changed by decrements of a predetermined value $\alpha$ from the first air-fuel ratio to the second air-fuel ratio (see FIGS. 7A and 7B);

(2) During a shift of engine operating conditions from the second range to the first range, the target air-fuel ratio Caf(K) is gradually changed by decrements of a predetermined value $\alpha$ from the second air-fuel ratio to the first air-fuel ratio;

(3) During a shift of engine operating conditions from the first range to the third range, the target air-fuel ratio Caf(K) is changed from the first air-fuel ratio directly to the third air-fuel ratio (see FIGS. 7C and 7D); and (4) During a shift of engine operating conditions from the first range to the third range, the target air-fuel ratio Caf(K) is changed from the third air-fuel ratio directly to the first air fuel ratio.

As shown in FIG. 8, when engine operating conditions, i.e. the engine load and engine speed, shift from the zone for the air-fuel ratio having the excessive air rate $\lambda$ of 1 (one) into the lean zone for the air-fuel ratio having the excessive air rate $\lambda$ larger than 1 (one) as shown by an arrow (I) in FIG. 5, the target air-fuel ratio is changed toward the rich side gradually taking a serious view of prevention of torque shocks. On the other hand, when engine operating conditions shift from the lean zone for the air-fuel ratio having the excessive air rate $\lambda$ larger than 1 (one) into the zone for the air-fuel ratio having the excessive air rate $\lambda$ of 1 (one) as shown by an arrow (II) in FIG. 5, the target air-fuel ratio is changed toward the rich side abruptly taking a serious view of prevention of an engine stall.

Figure 9:
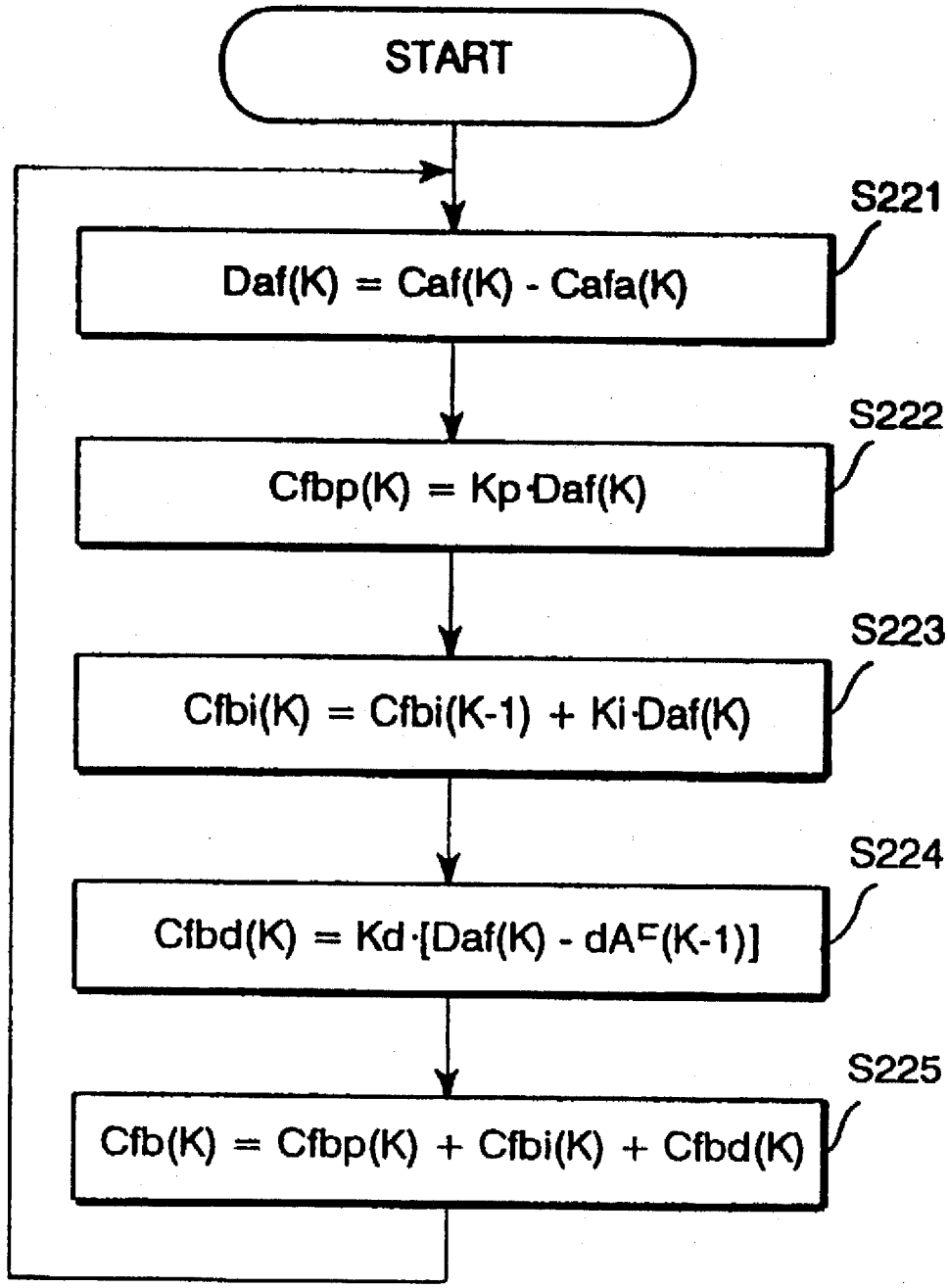
FIG. 9 is a flow chart of a sequence routine of the determination of a feedback control value.

Referring to FIG. 9, which is a flow chart of the sequence routine of calculating a feedback control correction value, the first step at step S221 is to calculate a deviation Daf(K) of the target air-fuel ratio Caf(K) from an actual air-fuel ratio Cafa(K) determined by the oxygen ($O_2$) sensor 14. At step 222, a proportional component Cafp(K) of the feedback control correction value is obtained by multiplying the air-fuel ratio deviation Daf(K) by a proportional gain Kp. An integral component Cafl(K) of the feedback control correction value is subsequently obtained at step 223 by adding to the preceding integral component Cafi(K−1) the air-fuel ratio deviation Daf(K) multiplied by an integral gain Ki. Further, a differential component Cafd(K) of the feedback control correction value is obtained at step S224 by multiplying the difference of the air-fuel ratio deviation Daf(K) from the preceding differential component Cafd(K−1) by a differential gain Kd.

Subsequently, these components Cafp(K), Cafi(K) and Cafd(K) are added together to obtain an eventual feedback control correction value Cafb(K) at step S225. The operation of obtaining an eventual feedback control correction value Cafb(K) is repeated after every predetermined sampling period. The feedback control is made by adding the eventual feedback control correction value Cafb(K) thus obtained to the basic amount of fuel deliver.

As apparent from the above, with the air-fuel control system of the present invention, during shifts between the first and second ranges of engine operating conditions, the target air-fuel ratio is gradually changed between the stoichiometric air-fuel ratio (second air-fuel ratio) and a lean air-fuel ratio (first air-fuel ratio), providing alleviation of torque shocks such as occurring due to sudden changes of air-fuel ratio and consequently ensuring tranquil operation of the engine. On the other hand, during shifts between the first and third ranges of engine operating conditions, the target air-fuel ratio is quickly and directly changed between the lean air-fuel ratio (first air-fuel ratio) and a rich air-fuel ratio (third air-fuel ratio), preventing a delay of tailing progression due to great changes in air-fuel ratio. Accordingly, the air-fuel control system of the present invention prevents considerable aggravation of responsiveness of engine output and insufficient preclusion of knocking due to a delayed enrichment or reduction in air-fuel ratio during transitions to the third range of engine operating conditions.

Engine operating conditions may divided into three ranges not based on engine speed but based on engine loads only, namely a low engine load range, a moderate engine load range and a high engine lead range, for three different and specific air-fuel ratios. Further, even in the case where there are not provided three ranges of engine operating conditions, by virtue of speeding up tailing progression with an increase in the amount of change in air-fuel ratio, the target air-fuel ratio is prevented from sudden and sharp changes so as to provide alleviation of torque shocks.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. An air-to-fuel ratio control system for an internal combustion engine for controlling the amount of a fuel mixture to be delivered into a combustion chamber so as to bring an air-to-fuel ratio toward a target air-to-fuel ratio, said air-to-fuel ratio control system comprising:

engine load monitoring means for monitoring an engine load at which the internal combustion engine operates; and air-to-fuel control means for setting the target air-to-fuel ratio to a predetermined lean level at which a lean fuel mixture is delivered while said engine load monitoring means monitors an engine load in a high range of engine loads higher than a specified level of engine load and to a predetermined rich level at which an enriched fuel mixture is delivered while said engine load monitoring means monitors an engine load in a low range of engine loads lower than said specified level of engine load, and varying said target air-to-fuel ratio between said lean level and said rich level faster when said engine load monitoring means monitors a change in engine load from said high range to said low range than when said engine load monitoring means monitors a change in engine load from said low range to said high range, and controlling an amount of fuel injection so as to deliver said target air-to-fuel ratio.

2. An air-to-fuel ratio control system as defined in claim 1, wherein said specified level of engine load is a load imposed on the engine during idling.

3. An air-to-fuel ratio control system as defined in claim 2, wherein said target air-to-fuel ratio is higher on said lean level than an stoichiometric air-to-fuel ratio and approximately equal on said rich level to said stoichiometric air-to-fuel ratio.

4. An air-to-fuel ratio control system as defined in claim 1, wherein said target air-to-fuel ratio is higher on said lean level than an stoichiometric air-to-fuel ratio and approximately equal on said rich level to said stoichiometric air-to-fuel ratio.

5. An air-to-fuel ratio control system as defined in claim 1, wherein said air-to-fuel control means gradually changes said target air-to-fuel ratio from a level before a change in engine load between said high range and said low range by a decrement depending upon said target air-to-fuel ratio multiplied by a fixed rate and a toward a level after said change in engine load between said high range and said low range by an increment depending upon said target air-to-fuel ratio multiplied by a fixed rate, each said fixed rates being varied between a change in engine load from said low range to said high range and a change in engine load from said high range to said low range.

6. An air-to-fuel ratio control system for an internal combustion engine for controlling the amount of a fuel mixture to be delivered into a combustion chamber so as to bring an air-to-fuel ratio toward a target air-to-fuel ratio, said air-to-fuel ratio control system comprising:

engine operating condition monitoring means for monitoring an engine operating condition under which the internal combustion engine operates; and air-to-fuel control means for setting the target air-to-fuel ratio to a predetermined lean level at which a lean fuel mixture is delivered while said engine operating condition monitoring means monitors an engine operating condition in a high range of engine operating conditions where engine speeds are higher than a specified speed and to a predetermined rich level at which an enriched fuel mixture is delivered while said engine operating condition monitoring means monitors an engine operating condition in a low range of engine operating conditions where engine speeds are lower than said specified speed, and varying said target air-to-fuel ratio between said lean level and said rich level faster when said engine operating condition monitoring means monitors a change in engine operating condition from said high range to said low range than when said engine operating condition monitoring means monitors a change in engine operating condition from said low range to said high range, and controlling an amount of fuel injection so as to deliver said target air-to-fuel ratio.

7. An air-to-fuel ratio control system as defined in claim 6, wherein said high range of engine operating conditions is further defined by engine loads higher than a specified level of engine load, and said low range of engine operating conditions is further defined by engine loads lower than said specified level of engine load.

8. An air-to-fuel ratio control system as defined in claim 7, wherein said target air-to-fuel ratio is higher on said lean level than an stoichiometric air-to-fuel ratio and approximately equal on said rich level to said stoichiometric air-to-fuel ratio.

9. An air-to-fuel ratio control system as defined in claim 6, wherein said target air-to-fuel ratio is higher on said lean level than an stoichiometric air-to-fuel ratio and approximately equal on said rich level to said stoichiometric air-to-fuel ratio.

10. An air-to-fuel ratio control system as defined in claim 6, wherein said air-to-fuel control means gradually changes aid target air-to-fuel ratio from a level before a change in engine load between said high range and said low range by a decrement depending upon said target air-to-fuel ratio multiplied by a fixed rate and toward a level after said change in engine load between said high range and said low range by an increment depending upon said target air-to-fuel ratio multiplied by a fixed rate, each said fixed rates being varied between a change in engine load from said low range to said high range and a change in engine load from said high range to said low range.

11. An air-to-fuel ratio control system for an internal combustion engine for controlling the amount of a fuel mixture to be delivered into a combustion chamber so as to bring an air-to-fuel ratio toward a target air-to-fuel ratio, said air-to-fuel ratio control system comprising:

engine operating condition monitoring means for monitoring an engine operating condition under which the internal combustion engine operates; and air-to-fuel control means for setting said target air-to-fuel ratio to a level differently according to engine operating conditions, changing said target air-to-fuel ratio from one level to another level according to a change in engine operating condition at a rate increased with an increase in deviation in said target air-to-fuel ratio between said one level and said other level, and controlling an amount of fuel injection so as to deliver said target air-to-fuel ratio.

12. An air-to-fuel ratio control system as defined in claim 11, wherein said air-to-fuel control means sets said target air-to-fuel ratio to a first level for a moderate range of engine loads, a second level lower than said first level for a low range of engine loads defined on a lower side of said moderate range, and a third level lower than said second level for a high range of engine loads defined on a higher side of said moderate range and varies said target air-to-fuel ratio at a rate greater during a change between said first level and said third level than during a change between said first level and said second level.

13. An air-to-fuel ratio control system as defined in claim 12, wherein said target air-to-fuel ratio is higher on said lean level than a stoichiometric air-to-fuel ratio and approximately equal on said rich level to said stoichiometric air-to-fuel ratio.

14. An air-to-fuel ratio control system as defined in claim 11, wherein said specific level of engine load is a load imposed on the engine during idling.

15. An air-to-fuel ratio control system as defined in claim 14, wherein said target air-to-fuel ratio is higher on said lean level than an stoichiometric air-to-fuel ratio and approximately equal on said rich level to said stoichiometric air-to-fuel ratio.

16. An air-to-fuel ratio control system as defined in claim 14, wherein said air-to-fuel control means gradually changes said target air-to-fuel ratio from a level before a change in engine load between said high range and said low range by a decrement depending upon said target air-to-fuel ratio multiplied by a fixed rate and toward a level after said change in engine load between said high range and said low range by an increment depending upon said target air-fuel ratio multiplied by a fixed rate, each said fixed rates being varied between a change in engine load from said low range to said high range and a change in engine load from said high range to said low range.

* * * * *